US006994056B1

(12) United States Patent
Boros

(10) Patent No.: US 6,994,056 B1
(45) Date of Patent: Feb. 7, 2006

(54) WATER HEATER HAVING A LOW NOX BURNER INTEGRATED WITH FVIR PLATFORM

(75) Inventor: Jozef Boros, Montgomery, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/934,648

(22) Filed: Sep. 3, 2004

(51) Int. Cl.
*F24H 9/20* (2006.01)

(52) U.S. Cl. ..... 122/14.1

(58) Field of Classification Search ..... 122/14.1, 122/14.2, 14.31
See application file for complete search history.

(56) References Cited

U.S. PATENT DOCUMENTS

| | | | | |
|---|---|---|---|---|
| 4,375,273 | A | 3/1983 | Erb et al. | |
| 5,402,603 | A | 4/1995 | Henley | |
| 6,035,812 | A | 3/2000 | Harrigill et al. | |
| 6,401,668 | B2 | 6/2002 | Valcic | |
| 6,418,883 | B2 | 7/2002 | Bourke et al. | |
| 6,497,200 | B2 | 12/2002 | Stretch et al. | |
| 6,698,386 | B1 * | 3/2004 | Hoffman | 122/14.31 |
| 6,715,451 | B2 * | 4/2004 | Stretch et al. | 122/504 |
| 6,761,134 | B1 * | 7/2004 | Trant | 122/14.1 |
| 2002/0092234 | A1 | 7/2002 | Staller et al. | |
| 2004/0069248 | A1 | 4/2004 | Stretch et al. | |

FOREIGN PATENT DOCUMENTS

WO PCT WO 00/06947 2/2000

* cited by examiner

*Primary Examiner*—Gregory Wilson
(74) *Attorney, Agent, or Firm*—Konneker & Smith, P.C.

(57) ABSTRACT

Various embodiments of fuel-fired low NOx water heaters are provided with burners having built-in venturi inlet sections for receiving fuel from a source thereof and combustion air from outside of the water heater. The burners are integrated in various manners with flammable vapor ignition resistance (FVIR) platforms to thereby reduce the tooling costs necessary to provide the water heaters with both lowered NOx emissions and flammable vapor ignition resistance.

47 Claims, 4 Drawing Sheets

WATER HEATER HAVING A LOW NOX BURNER INTEGRATED WITH FVIR PLATFORM

BACKGROUND OF THE INVENTION

The present invention generally relates to fuel-fired heating appliances and, in representatively illustrated embodiments thereof, more particularly provides specially designed fuel-fired water heaters with low NOx burners having integral venturi fuel/air inlet structures therein, and being integrated with flammable vapor ignition resistance (FVIR) platforms.

Residential gas-fired water heaters are required to meet reduced NOx emission standards effective in 2005 for certain Air Quality Management Districts (AQMD's) of California and Texas. Recently, various gas-fired water heaters have been redesigned to provide them with flammable vapor ignition resistance (FVIR) in accordance with the Z21 ANSI standards. Significant tooling investment has been made to create new water heater platforms, complete with flame arrestors, damper plate assemblies with combustion air shutoff devices, and perforated jacket assemblies to channel and filter air.

It would be desirable to incorporate in these FVIR-redesigned water heaters low NOx fuel burners, which would provide the water heaters with the required lowered NOx emission rates, in a manner which would reduce or eliminate the need for platform redesigns. It is to this goal that the present invention is primarily directed.

SUMMARY OF THE INVENTION

In carrying out principles of the present invention, in accordance with a preferred embodiment thereof, a fuel-fired heating appliance, representatively but not by way of limitation a gas-fired water heater, is provided with a low NOx fuel burner which is integrated with a flammable vapor ignition resistance (FVIR) platform. In illustrated embodiments thereof, the water heater comprises a combustion chamber separated from a plenum area by a wall structure, an inlet space for receiving combustion air from outside the water heater, and a fuel burner.

The fuel burner has a hollow body with an outlet portion thereof projecting from the wall structure into the combustion chamber, and an inlet portion projecting from the wall structure into the plenum area. The inlet portion of the fuel burner has a venturi inlet structure associated therewith and operative to flow combustion air from the inlet space into the inlet portion of the burner body. To lower the NOx emissions of the burner, preferably all of the primary combustion air delivered to the burner comes from outside of the water heater and is illustratively flowed to the venturi inlet structure via the plenum area.

Illustratively, the fuel burner is a radiant burner having a perforate flame-holding wall section, which may be of a metal mesh construction, which is disposed on the outlet portion of the burner body. This perforate wall section provides the water heater with flammable vapor ignition resistance, the flame-holding wall section serving to preclude flame outflow from the combustion chamber. This flammable vapor ignition resistance may be augmented by disposing flame quenching openings in the bottom wall structure of the combustion chamber by, for example, placing a perforated flame arrestor plate therein.

According to one aspect of the invention, the venturi inlet structure of the burner is formed as an integral portion of its inlet portion disposed within the plenum area, thus integrating a low NOx burner with an FVIR platform. Alternatively, the venturi inlet structure, which is representatively an air inlet conduit structure extending through the plenum area or simply a venturi opening formed in an outer wall of the burner body inlet portion, may be a separate structure attached to the burner body inlet portion. Fuel is supplied to the burner via a fuel supply tube suitably routed through an interior portion of the water heater to the burner.

In one illustrated embodiment thereof, the water heater is also provided with a combustion shutoff system functioning to automatically terminate combustion in response to the presence of a predetermined, unacceptably high temperature within the combustion chamber which may be caused, for example, by the combustion therein of extraneous flammable vapors ingested from outside the water heater. In a representative embodiment thereof, the combustion shutoff system is operative to terminate combustion air flow to the burner and comprises a temperature sensing structure disposed within the combustion chamber an linked to a spring-loaded damper structure releasable by the temperature sensing structure, to close the inlet of the burner venturi inlet structure, in response to the combustion chamber temperature reaching a set point temperature of the temperature sensing structure.

In illustrated representative embodiments thereof, the water heater has an inner wall structure defining a tank for holding water to be heater, a combustion chamber extending downwardly from a lower end of the tank and having a bottom wall structure, and a skirt wall depending from a bottom peripheral portion of the combustion chamber and circumscribing a plenum area separated from the combustion chamber by the bottom wall structure, the skirt wall having an opening therein.

An outer wall structure outwardly circumscribes the inner wall structure and defines therewith an air inlet space at least partially circumscribing the skirt wall, the outer wall structure having a combustion air inlet opening area extending therethrough into the air inlet space. The fuel burner is illustratively a radiant burner and has a hollow body with an upper outlet portion thereof projecting from the combustion chamber bottom wall structure into the combustion chamber, and a lower inlet portion projecting from the bottom wall structure into the plenum area, the inlet portion having a venturi inlet structure associated therewith and having an inlet communicated with the air inlet space in a manner permitting combustion air entering the air inlet space through said combustion air inlet opening area from outside the water heater to be drawn into said inlet of the venturi inlet structure. Preferably, all of the primary combustion air delivered to the burner flows through its venturi inlet structure, comes from outside of the water heater, and is flows flowed to the inlet of the venturi structure via the interior of the skirted plenum area.

The water heater also includes fuel delivery apparatus for delivering fuel from a source thereof to the interior of said lower inlet portion of said hollow body for mixture with combustion air flowed thereinto via said venturi inlet structure. Representatively, the fuel delivery apparatus includes a fuel supply tube appropriately routed through an interior portion of the water heater to operatively supply fuel gas, from a source thereof, to the burner.

According to various other aspects of the invention, the flame-holding wall section of the radiant burner is removable from the balance of the burner for cleaning and inspection purposes, the combustion air inlet opening area includes a series of air filtering perforations formed in the outer wall structure, and the water heater may have incorporated therein the aforementioned combustion shutoff system together with the flammable vapor ignition resistance structure which includes the flame-holding wall section of the radiant burner.

In accordance with further features of the invention, in illustrated embodiments of the water heater the bottom wall structure of the combustion chamber is defined by a peripheral portion of the fuel burner captively and supportingly retained in a circumferential rolled portion of the inner wall structure. In another illustrated embodiment of the water heater the bottom wall structure of the combustion chamber is separate from the fuel burner and has an opening through which the fuel burner vertically extends. The fuel burner is releasably interlocked with the bottom wall structure and is downwardly removable from the combustion chamber through the opening in the separate bottom wall structure. The fuel burner is releasably interlocked with the bottom wall structure by cooperating tab and slot structures on the fuel burner and bottom wall structure, and is interlockable with and releasable from the bottom wall structure by rotating the fuel burner relative to the bottom wall structure about a vertical axis.

When released from the bottom wall structure the fuel burner may be removed from the water heater by withdrawing the released fuel burner outwardly through aligned access openings in the inner and outer wall structures. The venturi inlet structure of this burner embodiment has a cover member secured thereto and adapted to cover the access opening in the inner wall structure when the fuel burner is supportingly interlocked with the bottom wall structure.

According to another aspect of the invention, in one embodiment thereof the water heater further includes a flue pipe extending upwardly from a central portion of the lower end of the tank. The upper outlet portion of the hollow burner body has a nonperforate central top side portion underlying the flue pipe, and the perforate flame holding wall section of the burner at least partially circumscribes this nonperforate central top side portion and slopes downwardly and inwardly towards it. In this manner, clogging of the flame-holding wall section by scale falling from the interior of the flue pipe is substantially reduced.

Various combustion air inlet flow paths through the interior of the water heater are representatively utilized in illustratively depicted embodiments of the water heater. These combustion air inlet flow paths include one in which the inlet of the venturi inlet structure receives combustion air from the air inlet space via the interior of the plenum area, another in which the inlet of the venturi inlet structure is disposed within the plenum area, and a further one in which the inlet of the venturi inlet structure is disposed within the air inlet space, and the water heater further includes an inlet passage for flowing combustion air from outside the water heater through the air inlet opening area and into the plenum area for delivery outwardly therefrom, via the skirt wall opening, into the air inlet space.

As will be readily appreciated by those of skill in this particular art, the present invention is not limited to water heaters, but could also be advantageously incorporated in other types of fuel-fired heating appliances such as, for example, boilers and fuel-fired air heating furnaces. Additionally, while the various water heater embodiments representatively illustrated and described herein have been indicated as incorporating radiant fuel burners therein, it will also be readily appreciated by those of skill in this particular art that other types of fuel burners could alternatively be utilized if desired without departing from principles of the present invention.

DETAILED DESCRIPTION

Figure 1:
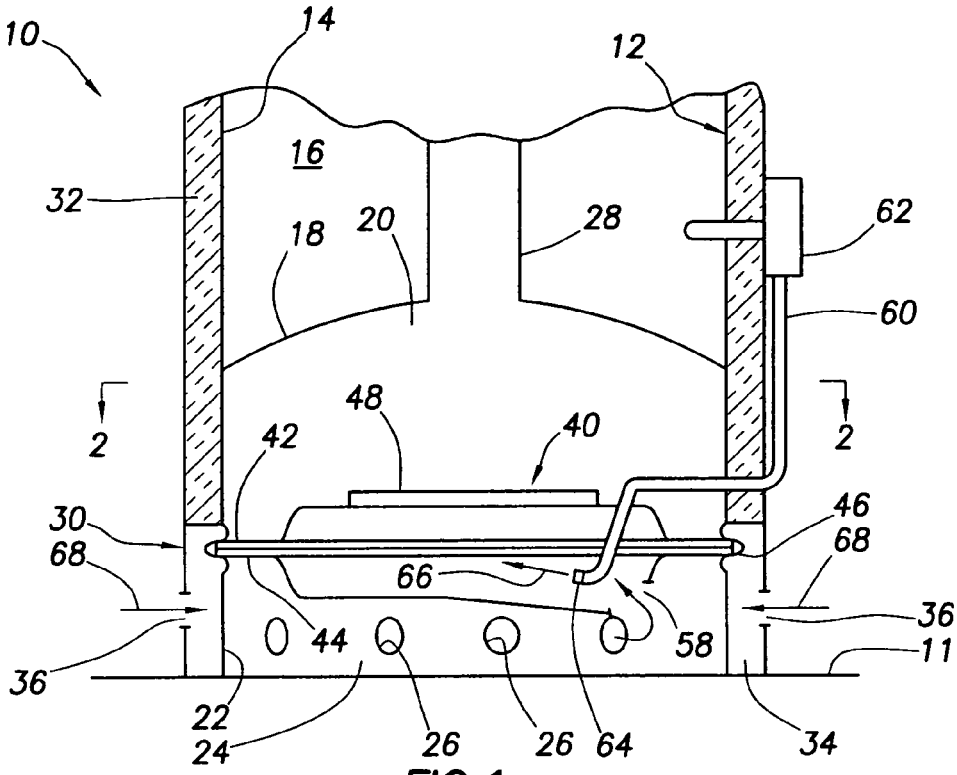
FIG. 1 is a schematic cross-sectional view through a lower end portion of a gas-fired water heater embodying principles of the present invention.

Cross-sectionally illustrated in schematic form in FIG. 1 is a fuel-fired heating appliance, representatively a gas-fired water heater 10, embodying principles of the present invention. Water heater 10 rests upon a horizontal support surface, such as the illustrated floor 11, and has a vertically oriented tubular inner wall structure 12. Inner wall structure 12 defines, along an upper portion thereof, a tank 14 adapted to hold a quantity of water 16 to be heated and having a domed bottom end wall 18, a combustion chamber 20 extending downwardly from a peripheral portion of the end wall 18, and an annular skirt wall 22 extending downwardly from the periphery of the combustion chamber 20 to the floor 11 and circumscribing a plenum 24 disposed beneath the combustion chamber 20. A circumferentially spaced series of air transfer openings 26 extend through the skirt wall 22 into the plenum 24. Extending upwardly from the bottom tank end wall 18, through the stored water 16, is a flue pipe 28 that communicates at its lower end with the interior of the combustion chamber 20.

A vertically oriented tubular metal outer wall structure, representatively in the form of a metal jacket 30, outwardly circumscribes the inner wall structure 12 and forms therewith an annular space, an upper portion of which is filled with a suitable insulation material 32, and a lower end portion of which forms an annular air inlet or receiving space 34 which outwardly circumscribes the skirt wall 22. A circumferentially spaced series of combustion air inlet openings 36 extend through a lower end portion of the jacket 30 into the annular space 34.

Water heater 10 also includes a radiant gas burner 40, the hollow body of which is formed from abutting upper and lower metal pan structures 42,44 having circular peripheral edge flange portions supportingly received in a circumferentially rolled portion 46 of the inner wall structure 12. As can be seen in FIG. 1, a peripheral flange portion of the burner 40 defines the bottom wall of the combustion chamber 20, with an upper or outlet portion of hollow body of the burner 40 projecting upwardly from such bottom wall into the interior of the combustion chamber 20, and a lower or inlet portion of the hollow body of the burner 40 projecting downwardly from such bottom wall into the skirt plenum 24.

On the top side of the burner 40 is a metal mesh burner screen structure 48 (see. FIGS. 1–4) which functions as a perforate flame-holding surface or wall structure during firing of the burner. The screen structure 48 may be removed from the balance of the burner 40 and withdrawn from the combustion chamber, for inspection and cleaning purposes, through suitable aligned access openings (not illustrated herein) formed in the outer wall structure 30 and a vertical side wall portion of the combustion chamber 20. During firing of the burner 40, as later described herein, the burner generates hot combustion products which flow upwardly through the flue 28 and heat the stored water 16 to maintain it at a predetermined heated temperature.

Figure 2:
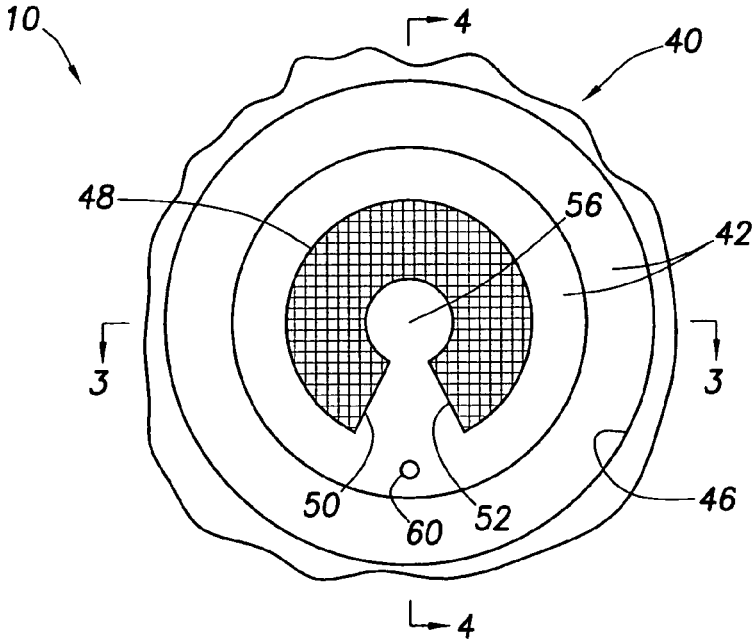
FIG. 2 is a partial cross-sectional view through the water heater taken along line 2—2 of FIG. 1.
Figure 3:
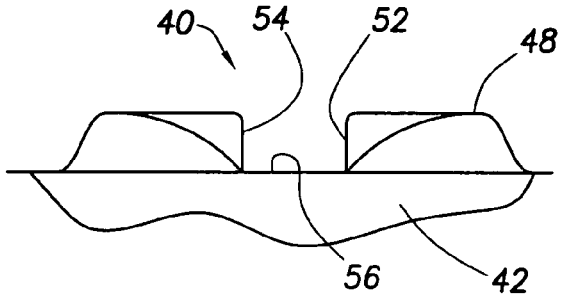
FIG. 3 is an enlarged scale cross-sectional view through the water heater taken along line 3—3 of FIG. 2.
Figure 4:
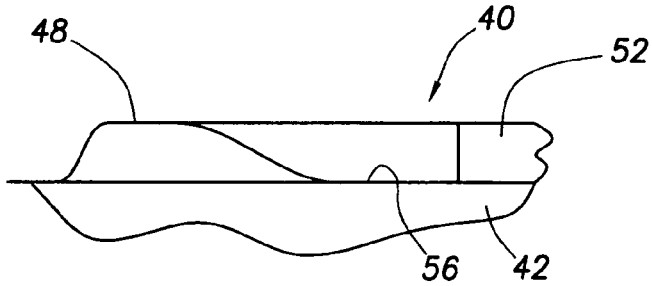
FIG. 4 is an enlarged scale cross-sectional view through the water heater taken along line 4—4 of FIG. 2.

As can best be seen in FIGS. 2–4, the removable screen structure 48 (which may be of an alternative perforate construction such as a porous ceramic material), has a partially annular configuration as viewed from the top, and has opposite, circumferentially spaced apart ends 50,52. Removable screen 48 circumscribes a generally circular, non-screened central area 56 of the upper burner pan structure 42 that underlies the open lower end of the flue 28, with the screen 48 sloping downwardly and radially inwardly toward the non-screened central area 56. In this manner, scale falling from the interior of the flue 28 tends to land in the central area 56 and thus does not tend to plug the screen 48. Additionally, scale landing on the screen 48 tends to fall down its inwardly sloped surface onto the non-screened central area 56.

The burner screen 48 provides the water heater 10 with flammable vapor ignition resistance (FVIR) to substantially prevent flames within the combustion chamber 20 (caused, for example, by ignition of extraneous flammable vapors ingested into the combustion chamber) from downwardly exiting the combustion chamber 28, the various small openings in the screen area 48 serving as flame quenching openings that permit fuel and air to upwardly traverse the screen, but preclude the passage of flames downwardly therethrough.

As illustrated in FIG. 1, the lower burner pan structure 44 forms within the skirt plenum 24 a burner venturi inlet opening 58 that is an integral portion of the burner 40 and communicates the interior of the plenum 24 with the interior of the burner 40. A fuel gas supply tube 60 is connected to a thermostatic gas valve 62 and extends downwardly therefrom through a portion of the combustion chamber 20 and into the interior of the burner 40. A suitable gas discharge nozzle 64 is connected to the lower outlet end of the tube 60 within the interior of the burner 40 adjacent its integral inlet opening 58.

During firing of the burner 40, fuel gas 66 is discharged from the nozzle 64 into the interior of the burner 40, and combustion air 68 from outside the water heater 10 sequentially flows inwardly through the combustion air inlet openings 36 into the annular space 34, from the annular space 34 into the skirt plenum area 24 via the skirt wall openings 26, and from the skirt plenum area 24 into the interior of the burner 40 through its integral venturi inlet opening 58. Combustion air 68 entering the interior of the burner 40 in this manner is mixed with the discharged fuel gas 66 to form a fuel/air mixture that passes upwardly through the removable burner screen 48 and is suitably ignited to form the previously mentioned hot combustion products within the combustion chamber 20 and heat the stored tank water 16.

As can be seen, all of the primary combustion air supplied to the burner 40 comes from outside the water heater 10. Accordingly, the NOx emissions generated by the burner 40 are quite low. Thus, the representatively illustrated water heater 10, in a simple, efficient and economical manner, integrates a low NOx fuel burner with a flammable vapor ignition resistance structure.

Figure 5:
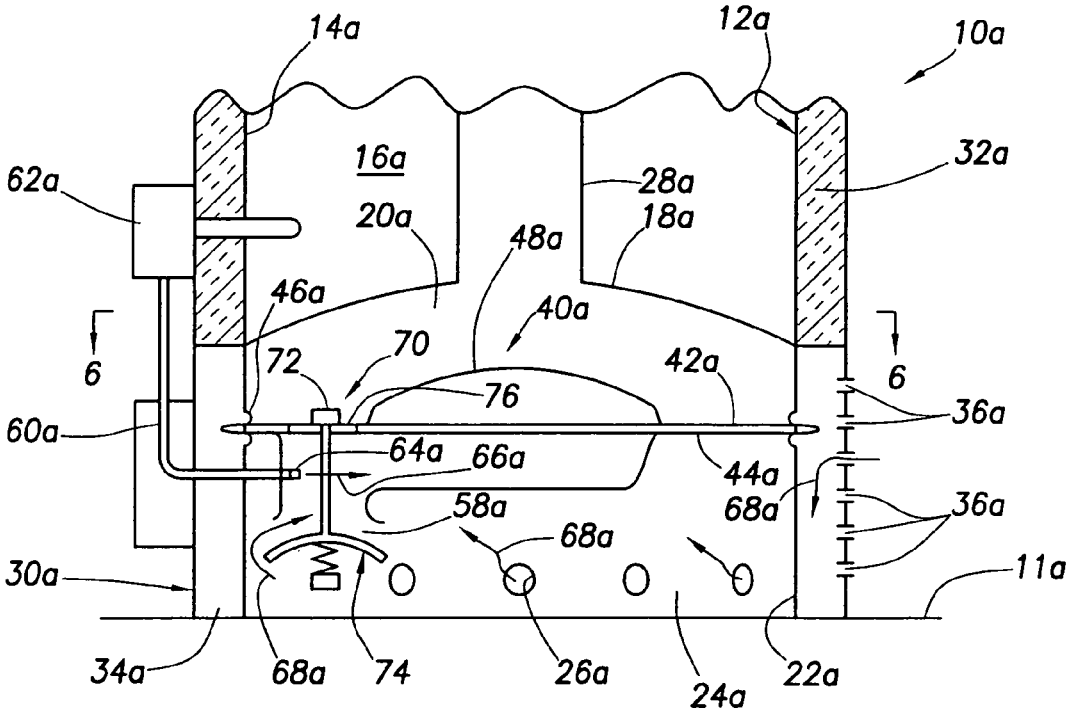
FIG. 5 is a schematic cross-sectional view through a lower end portion of a first alternate embodiment of the FIG. 1 water heater.
Figure 6:
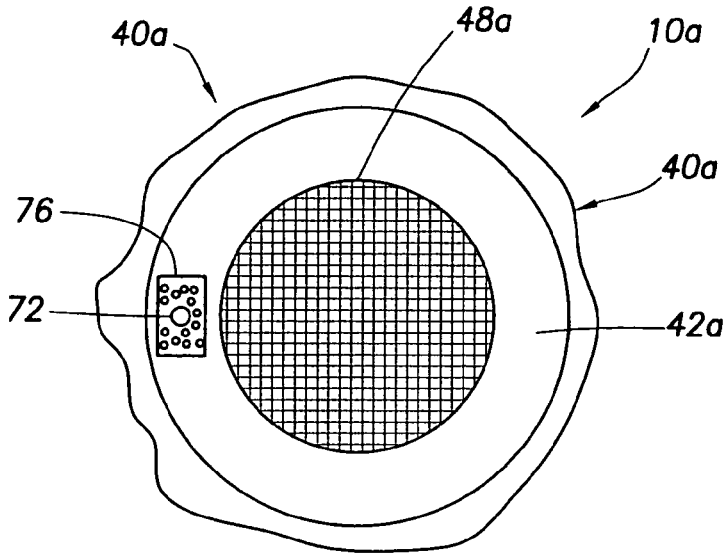
FIG. 6 is a partial cross-sectional view through the FIG. 5 water heater taken along line 6—6 of FIG. 5.

A first alternate embodiment 10*a* of the previously described water heater 10 is schematically shown in FIGS. 5 and 6. For ease in comparing the water heaters 10 and 10*a*, components in the water heater 10*a* similar to those in the previously described water heater 10 have been given the same reference numerals to which the subscripts "a" have been added. Water heater 10*a* is similar in construction and operation to the previously described water heater 10 with the following exceptions.

In the water heater 10*a*, the removable burner screen 48*a* has a fully domed configuration, and the combustion air inlet openings 36*a* formed in the jacket wall 30*a* are particulate filtering perforations operative to filter out, for example, lint, dirt and oil from combustion air 68*a* entering the annular space 34*a* to reduce potential clogging of the burner screen 48*a*. As an alternative to these filtering perforations in the jacket wall 30*a*, a separate filtering structure could be appropriately installed in a suitable mounting opening in the jacket wall 30*a*. The integral burner venturi inlet opening 58*a* disposed within the skirt plenum 24*a* faces downwardly and forms a portion of a combustion shutoff system 70 incorporated in the water heater 10*a*.

The combustion shutoff system 70 functions to terminate combustion in the combustion chamber 20*a*, representatively by precluding further combustion air flow to the burner 40*a*, in response to the detection of an undesirably high temperature in the combustion chamber 20*a* which may be caused, for example, by the combustion therein of ingested extraneous flammable vapors from outside the water heater 10*a*. Combustion shutoff system 70 representatively includes a temperature sensing structure 72 disposed within the combustion chamber 20*a* and linked to a spring-loaded shutoff damper assembly 74 which is normally held in its indicated open position in which it permits combustion air 68*a* to flow into the interior of the burner 48*a* through its integral venturi inlet opening 58*a*.

Upon detecting a predetermined, undesirably high temperature within the combustion chamber 20*a*, the temperature sensing structure 72 permits the damper structure 74 to be spring-driven upwardly in a manner causing the damper structure 74 to close off the burner inlet opening 58*a*. The temperature sensing structure 72 is located over a perforated arrestor plate 76 (see FIG. 6) inset into peripheral portions of the upper and lower burner pan structures 42,44. The perforated arrestor plate 76 serves to prevent outflow of flames from the interior of the combustion chamber 20*a* (augmenting the flame outflow prevention of the burner screen 48*a*), and additionally functions to provide combustion chamber pressure relief during normal ignition and operation of the burner 40*a*. Temperature sensing structure 72 and its associated spring-loaded shutoff damper structure 74 may be similar in construction and operation to any of those shown in U.S. Pat. No. 6,715,451 which is hereby incorporated by reference herein.

Like the previously described water heater 10, the water heater 10*a* desirably integrates a low NOx fuel burner with an FVIR platform in a simple, efficient and economical manner.

Figure 7:
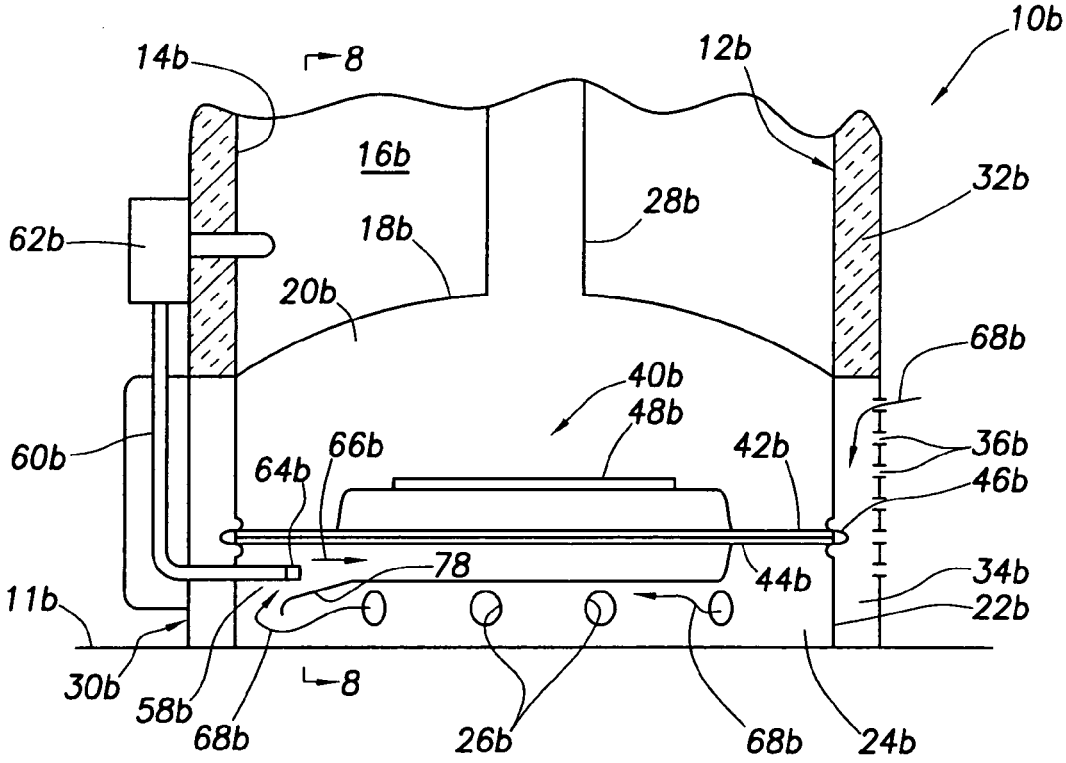
FIG. 7 is a schematic cross-sectional view through a lower end portion of a second alternate embodiment of the FIG. 1 water heater.
Figure 8:
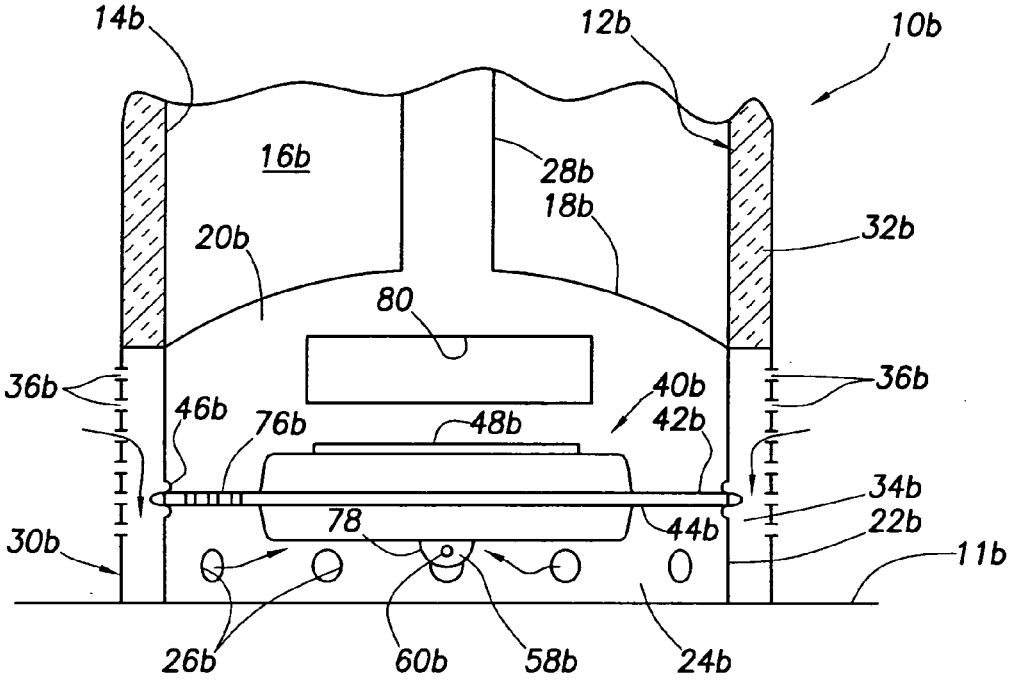
FIG. 8 is a cross-sectional view through the FIG. 7 water heater taken along line 8—8 of FIG. 7.

Cross-sectionally illustrated in schematic form in FIGS. 7 and 8 is a second alternate embodiment 10*b* of the previously described water heater 10 shown in FIG. 1. Water heater 10*b*, with the exceptions noted below, is similar in construction and operation to the previously described water heater 10*a* shown in FIGS. 5 and 6. To facilitate the comparison of water heaters 10*b* and 10*a*, components in the water heater 10*b* similar to those in water heater 10*a* have been given identical reference numerals to which the subscripts "b" have been added.

Water heater 10*b* representatively does not incorporate the previously described combustion shutoff system 70 therein, and, compared to the water heater 10*a*, has a somewhat modified burner configuration. Specifically, as shown in FIGS. 7 and 8, the burner 40*b* has a generally horizontally extending venturi inlet conduit 78 formed as an integral portion of the bottom burner pan 44*b* and disposed within the skirt plenum area 24*b*, the venturi inlet conduit 78 having, at its horizontally outer end, the inlet opening 58*b* as illustrated in FIG. 7. The fuel gas tube 60*b* extends horizontally into the conduit 78 through its inlet opening 58*b*. The removable burner screen structure 48*b* is withdrawable from the combustion chamber 20*b*, for inspection and cleaning, through an appropriately covered combustion chamber side wall access opening 80 and a corresponding jacket side wall access opening (not visible). Like the previously described water heaters 10 and 10*a*, the water heater 10*b* desirably integrates a low NOx fuel burner with an FVIR platform in a simple, efficient and economical manner.

Figure 9:
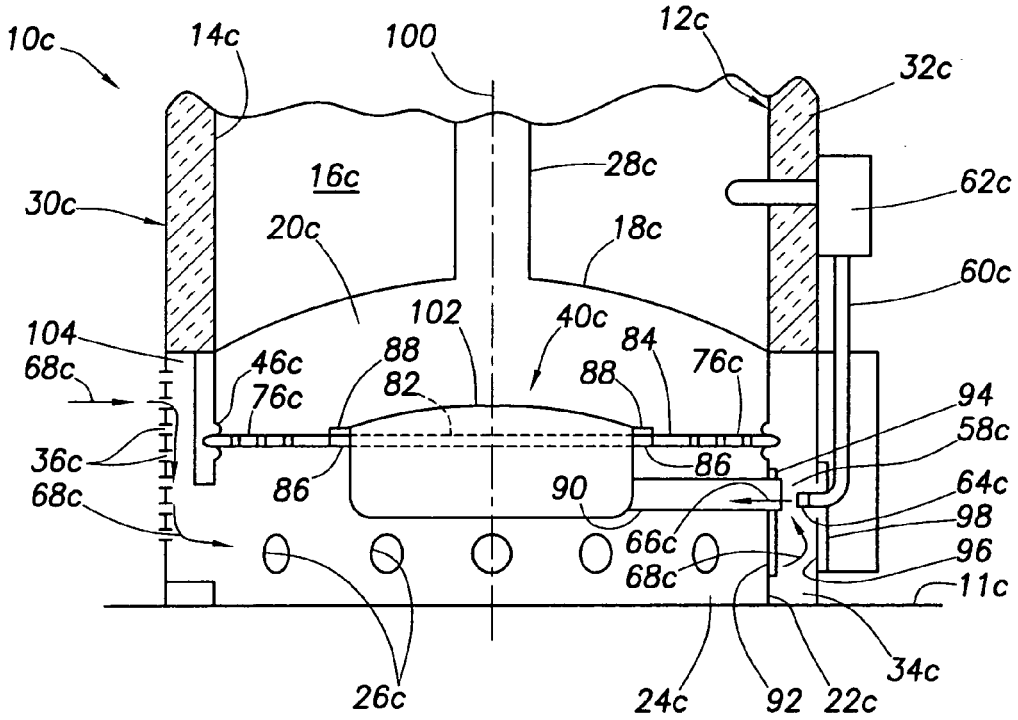
FIG. 9 is a schematic cross-sectional view through a lower end portion of a third alternate embodiment of the FIG. 1 water heater.

A third alternate embodiment 10*c* of the previously described water heater 10 shown in FIG. 1 is schematically depicted in cross-sectional form in FIG. 9. Water heater 10*c*, with the exceptions noted below, is similar in construction and operation to the previously described water heater 10*b* shown in FIGS. 7 and 8. TO facilitate the comparison of water heaters 10*c* and 10*b*, components in the water heater 10*c* similar to those in water heater 10*b* have been given identical reference numerals to which the subscripts "c" have been added.

In the water heater 10*c* shown in FIG. 9, the burner 40*c* does not have peripheral portions which are supportingly received in the roll portion 46*c*. Instead, the body of the operatively installed burner 40*c* extends downwardly through a central circular opening 82 formed in a separate circular metal plate 84 forming the bottom wall of the combustion chamber 20*c* and having a peripheral edge portion supportingly received in the roll portion 46*c*. Diametrically opposite notches 86 are formed in the plate 84 and extend radially outwardly from the periphery of its central opening 82. A pair of corresponding diametrically opposite tabs 88 project radially outwardly from an upper peripheral portion of the burner 40*c*.

Horizontally extending outwardly from a lower portion of the burner 40*c* which projects downwardly into the skirt plenum area 24*c* is a venturi conduit 90 having, at its outer end, the venturi inlet 58*c*. Conduit 90 extends outwardly through an access opening 92 in the skirt wall 22*c*, with an outer end portion of the conduit 90 being fixedly secured within a removable access cover 94 extending across the access opening 92. As illustrated, the inlet opening 58*c* of the venturi conduit 90 is disposed within the annular space 34*c* for receiving fuel 66*c* from the discharge orifice 64*c*. An access opening 96 is formed through the jacket 30*c*, in alignment with the combustion chamber access opening 92, with a removable cover 98 extending across the access opening 96.

With the covers 94,98 removed, the burner 40*c* is installed within the water heater 10*c* by inserting the burner body inwardly through the aligned access openings 96,92 in an orientation in which the burner tabs 88 underlie the plate notches 86 and the access cover 94 is closely adjacent the access opening 92. The burner 40*c* is then moved upwardly to place an upper burner portion within the combustion chamber 20*c* and move the burner tabs 88 upwardly through the plate notches 86. Finally, the inserted burner 40*c* is rotated about the indicated vertical axis 100 to cause the tabs 88 to overlie the plate 84 and operatively support the burner 40*c* within the water heater 40*c*. This also brings the cover member 94 into a covering relationship with the access opening 92. The other removable cover 98 is then installed over the jacket access opening 96. TO remove the installed burner 40*c* for inspection and cleaning, this process is simply reversed. The wire mesh top side section 102 of the installed burner 40*c*, in conjunction with the indicated perforated flame arrestor plates 76*c* installed in the plate 84, provides the water heater 10*c* with flammable vapor ignition resistance.

The indicated particulate filtering perforations 68*c* formed in the jacket 30*c* are positioned diametrically oppositely from the venturi conduit inlet 58*c* and communicate with an enclosed passageway 104 extending through annular space 34*c* and opening into the skirt plenum area 24*c*. During firing of the water heater 10*c*, combustion air 68*c* from outside the water heater 10*c* flows sequentially through the combustion air inlet perforations 36*c* into the interior of the skirt plenum area 24*c* via the enclosed passageway 104, outwardly from the skirt plenum area into the annular space 34*c* through the air transfer openings 26*c*, and then into the venturi conduit inlet 58*c* for mixture with fuel 66*c* being discharged from the fuel nozzle 64*c* to form the fuel/air mixture ignited by the burner 40*c*.

Like the previously described water heaters 10, 10*a* and 10*b*, the water heater 10*c* desirably integrates a low NOx fuel burner with an FVIR platform in a simple, efficient and economical manner.

While various principles of the present invention have been representatively illustrated and described herein as being incorporated in a fuel-fired water heater, it will be readily appreciated by those of skill in this particular art that the present invention is not limited to water heaters, but could also be advantageously incorporated in other types of fuel-fired heating appliances such as, for example, boilers and fuel-fired air heating furnaces.

Additionally, while the various water heater embodiments representatively illustrated and described herein have been indicated as incorporating radiant fuel burners therein, it will also be readily appreciated by those of skill in this particular art that other types of fuel burners could alternatively be utilized if desired without departing from principles of the present invention.

The foregoing detailed description is to be clearly understood as being given by way of illustration and example only, the spirit and scope of the present invention being limited solely by the appended claims.

What is claimed is:

1. A fuel-fired heating appliance comprising:

a combustion chamber separated from a plenum area by a wall structure;

an inlet space for receiving combustion air from outside said appliance; and a fuel burner having a hollow body with an outlet portion thereof projecting from said wall structure into said combustion chamber, and an inlet portion thereof projecting from said wall structure into said plenum area, said inlet portion having a venturi inlet structure associated therewith, communicated with said inlet space, and operative to flow combustion air from said inlet space into said inlet portion of said hollow body, said wall structure being defined by a peripheral portion of said fuel burner.

2. The fuel-fired heating appliance of claim 1 wherein:

said venturi inlet structure is operative to flow combustion air from said inlet space into said inlet portion of said hollow body via said plenum area.

3. The fuel-fired heating appliance of claim 1 wherein:

said appliance is a fuel-fired water heater.

4. The fuel-fired heating appliance of claim 3 wherein:

said water heater is a gas-fired water heater.

5. The fuel-fired heating appliance of claim 1 wherein:

said fuel burner is a radiant fuel burner.

6. The fuel-fired heating appliance of claim 1 wherein:

said venturi inlet structure is an integral portion of said inlet portion of said hollow fuel burner body.

7. The fuel-fired heating appliance of claim 6 wherein;

said venturi inlet structure includes an outer wall opening formed in said inlet portion of said hollow fuel burner body.

8. The fuel-fired heating appliance of claim 1 wherein:

said venturi inlet structure includes an inlet conduit structure extending outwardly from said inlet portion of said hollow fuel burner body.

9. The fuel-fired heating appliance of claim 8 wherein:

said inlet space is external to said plenum area, and said inlet conduit structure has an outer inlet end opening disposed in said inlet space.

10. The fuel-fired heating appliance of claim 1 wherein:

substantially all of the primary combustion air utilized by said fuel burner during firing thereof is delivered to said fuel burner through said venturi inlet structure.

11. A fuel-fired heating appliance comprising:

a combustion chamber separated from a plenum area by a wall structure;

an inlet space for receiving combustion air from outside said appliance; and a fuel burner having a hollow body with an outlet portion thereof projecting from said wall structure into said combustion chamber, and an inlet portion thereof projecting from said wall structure into said plenum area, said inlet portion having a venturi inlet structure associated therewith, communicated with said inlet space, and operative to flow combustion air from said inlet space into said inlet portion of said hollow body, said wall structure being separate from said fuel burner and having an opening through which said fuel burner extends between said combustion chamber and said plenum area.

12. A fuel-fired heating appliance comprising:

a combustion chamber separated from a plenum area by a wall structure;

an inlet space for receiving combustion air from outside said appliance; and a fuel burner having a hollow body with an outlet portion thereof projecting from said wall structure into said combustion chamber, and an inlet portion thereof projecting from said wall structure into said plenum area, said inlet portion having a venturi inlet structure associated therewith, communicated with said inlet space, and operative to flow combustion air from said inlet space into said inlet portion of said hollow body, said venturi inlet structure including an inlet conduit structure extending outwardly from said inlet portion of said hollow fuel burner body, said inlet conduit structure having an outer inlet end opening disposed within said plenum area.

13. A fuel-fired heating appliance comprising:

a combustion chamber separated from a plenum area by a wall structure;

an inlet space for receiving combustion air from outside said appliance; and a fuel burner having a hollow body with an outlet portion thereof projecting from said wall structure into said combustion chamber, and an inlet portion thereof projecting from said wall structure into said plenum area, said inlet portion having a venturi inlet structure associated therewith, communicated with said inlet space, and operative to flow combustion air from said inlet space into said inlet portion of said hollow body said wall structure being defined by a peripheral portion of said fuel burner; and a combustion shutoff system operative to terminate combustion in said fuel-fired heating appliance in response to the temperature in said combustion chamber reaching a predetermined unacceptably high temperature.

14. The fuel-fired heating appliance of claim 13 wherein:

said combustion shutoff system is operative to terminate combustion air flow to said fuel burner in response to the temperature in said combustion chamber reaching said predetermined unacceptably high temperature.

15. The fuel-fired heating appliance of claim 14 wherein:

said combustion shutoff system is operative to block combustion air inflow through said venturi inlet structure in response to the temperature in said combustion chamber reaching said predetermined unacceptably high temperature.

16. A fuel-fired heating appliance comprising:

a combustion chamber separated from a plenum area by a wall structure;

an inlet space for receiving combustion air from outside said appliance; and a fuel burner having a hollow body with an outlet portion thereof projecting from said wall structure into said combustion chamber, and an inlet portion thereof projecting from said wall structure into said plenum area, said inlet portion having a venturi inlet structure associated therewith, communicated with said inlet space, and operative to flow combustion air from said inlet space into said inlet portion of said hollow body; and a flammable vapor ignition resistance system operative to prevent flame outflow from said combustion chamber.

17. The fuel-fired heating appliance of claim 16 wherein:

said fuel burner is a radiant fuel burner, said fuel burner outlet portion has a perforate flame holding outer wall section, and said flammable vapor ignition resistance system includes said perforate flame holding outer wall section.

18. The fuel-fired heating appliance of claim 16 wherein:

said flammable vapor ignition resistance system includes flame quenching openings associated with said wall structure and communicating said plenum area with said combustion chamber.

19. A fuel-fired water heater comprising:

an inner wall structure defining a tank for holding water to be heated, a combustion chamber extending downwardly from a lower end of said tank and having a bottom wall structure, and a skirt wall depending from a bottom peripheral portion of said combustion chamber and circumscribing a plenum area separated from said combustion chamber by said bottom wall structure, said skirt wall having an opening therein;

an outer wall structure outwardly circumscribing said inner wall structure and defining therewith an air inlet space at least partially circumscribing said skirt wall, said outer wall structure having a combustion air inlet opening area extending therethrough into said air inlet space;

a fuel burner having a hollow body with an upper outlet portion thereof projecting from said bottom wall structure into said combustion chamber, and a lower inlet portion projecting from said bottom wall structure into said plenum area, said inlet portion having a venturi inlet structure associated therewith and having an inlet communicated with said air inlet space in a manner permitting combustion air entering said air inlet space through said combustion air inlet opening area from outside said water heater to be drawn into said inlet of said venturi inlet structure; and fuel delivery apparatus for delivering fuel from a source thereof to the interior of said lower inlet portion of said hollow body for mixture with combustion air flowed thereinto via said venturi inlet structure.

20. The fuel-fired water heater of claim 19 wherein:

said fuel-fired water heater is a gas fired water heater.

21. The fuel-fired water heater of claim 20 wherein:

said combustion air inlet opening area includes a series of air filtering perforations formed in said outer wall structure.

22. The fuel-fired water heater of claim 20 wherein:

said fuel burner is a radiant fuel burner having, on said upper outlet portion of said hollow body, a perforate flame holding wall section.

23. The fuel-fired water heater of claim 22 wherein:

said perforate flame holding wall section is of a metal mesh construction.

24. The fuel-fired water heater of claim 22 wherein:

said perforate flame holding wall section is removable from said upper outlet portion of said hollow body for inspection and cleaning purposes.

25. The fuel-fired water heater of claim 22 wherein:

said water heater further comprises a flue pipe extending upwardly from a central portion of said lower end of said tank, said upper outlet portion of said hollow body has a nonperforate central top side portion underlying said flue pipe, and said perforate flame holding wall section at least partially circumscribes said nonperforate central top side portion and slopes downwardly and inwardly towards it.

26. The fuel-fired water heater of claim 19 wherein:

essentially all of the primary combustion air delivered from outside of said water heater to said fuel burner, during firing thereof, via said venturi inlet structure.

27. The fuel-fired water heater of claim 19 wherein:

said bottom wall structure of said combustion chamber is defined by a portion of said fuel burner.

28. The fuel-fired water heater of claim 27 wherein:

said bottom wall structure of said combustion chamber is a peripheral portion of said fuel burner captively and supportingly retained in a circumferential rolled portion of said inner wall structure.

29. The fuel-fired water heater of claim 19 wherein:

said bottom wall structure of said combustion chamber is separate from said fuel burner and has an opening through which said fuel burner vertically extends.

30. The fuel-fired water heater of claim 29 wherein:

said fuel burner is releasably interlocked with said bottom wall structure and is downwardly removable from said combustion chamber through said opening in said bottom wall structure.

31. The fuel-fired water heater of claim 30 wherein:

said fuel burner is releasably interlocked with said bottom wall structure by cooperating tab and slot structures on said fuel burner and said bottom wall structure.

32. The fuel-fired water heater of claim 31 wherein:

said fuel burner is interlockable with and releasable from said bottom wall structure by rotating said fuel burner relative to said bottom wall structure about a vertical axis.

33. The fuel-fired water heater of claim 30 wherein:

when released from said bottom wall structure said fuel burner may be removed from said water heater by withdrawing the released fuel burner outwardly through aligned access openings in said inner and outer wall structures.

34. The fuel-fired water heater of claim 33 wherein:

said venturi inlet structure has a cover member secured thereto and adapted to cover said access opening in said inner wall structure when said fuel burner is interlocked with said bottom wall structure.

35. The fuel-fired water heater of claim 19 wherein:

said inlet of said venturi inlet structure receives combustion air from said air inlet space via the interior of said plenum area.

36. The fuel-fired water heater of claim 19 wherein:

said inlet of said venturi inlet structure is disposed within said plenum area.

37. The fuel-fired water heater of claim 19 wherein:

said inlet of said venturi inlet structure is disposed within said air inlet space, and said fuel-fired water heater further comprises an inlet passage for flowing combustion air from outside said water heater through said air inlet opening area and into said plenum area for delivery outwardly therefrom, via said skirt wall opening, into said air inlet space.

38. The fuel-fired water heater of claim 19 wherein:

said fuel delivery apparatus includes a fuel delivery tube sequentially extending inwardly through said combustion chamber and said upper outlet portion of said fuel burner body, and then into said lower inlet portion of said fuel burner body, said fuel delivery tube having a discharge portion disposed within said lower inlet portion of said fuel burner body.

39. The fuel-fired water heater of claim 19 wherein:

said fuel delivery apparatus includes a fuel delivery tube sequentially extending inwardly through said outer and inner wall structures and then into said lower inlet portion of said fuel burner body, said fuel delivery tube having a discharge portion disposed within said lower inlet portion of said fuel burner body.

40. The fuel-fired water heater of claim 19 wherein:

said fuel delivery apparatus includes a fuel delivery tube extending inwardly through said outer wall structure into said air inlet space, said inlet of said venturi inlet structure is disposed in said air inlet space, and said fuel delivery tube has a discharge portion positioned to discharge fuel into said inlet of said venturi inlet structure.

41. The fuel-fired water heater of claim 19 further comprising:

a flammable vapor ignition resistance system operative to prevent flame outflow from said combustion chamber.

42. The fuel-fired water heater of claim 41 wherein:

said fuel burner is a radiant fuel burner, said fuel burner outlet portion has a perforate flame holding outer wall section, and said flammable vapor ignition resistance system includes said perforate flame holding outer wall section.

43. The fuel-fired water heater of claim 41 wherein:

said flammable vapor ignition resistance system includes flame quenching openings associated with said bottom wall structure of said combustion chamber and communicating said plenum area with said combustion chamber.

44. The fuel-fired water heater of claim 19 further comprising:

a combustion shutoff system operative to terminate combustion in said fuel-fired heating appliance in response to the temperature in said combustion chamber reaching a predetermined unacceptably high temperature.

45. The fuel-fired water heater of claim 44 wherein:

said combustion shutoff system is operative to terminate combustion air flow to said fuel burner in response to the temperature in said combustion chamber reaching said predetermined unacceptably high temperature.

46. The fuel-fired water heater of claim 45 wherein:

said combustion shutoff system is operative to block combustion air inflow through said venturi inlet structure in response to the temperature in said combustion chamber reaching said predetermined unacceptably high temperature.

47. The fuel-fired water heater of claim 46 wherein:

said combustion shutoff system includes a temperature sensing structure disposed in said combustion chamber and linked to a spring-loaded damper structure held by said temperature sensing structure in an open position permitting combustion air flow into said inlet of said venturi inlet section, said temperature sensing structure being operative to permit said damper structure to be spring-driven to a closed position, in which it blocks combustion air flow into said inlet, in response to detecting said unacceptably high temperature within said combustion chamber.

* * * * *